US005518139A

United States Patent [19]

Trower et al.

[11] Patent Number: 5,518,139

[45] Date of Patent: May 21, 1996

[54] PORTABLE STORAGE ASSEMBLY

[75] Inventors: David A. Trower; Fred P. Ritchie, both of Waterloo; Bryan J. Stow, Cedar Falls, all of Iowa

[73] Assignee: Waterloo Industries, Inc., Waterloo, Iowa

[21] Appl. No.: 157,910

[22] Filed: Nov. 24, 1993

[51] Int. Cl.[6] ..... B65D 21/00

[52] U.S. Cl. ..... 220/522; 206/379

[58] Field of Search ..... 220/522, 4.27, 220/23.83, 23.86, 775, 776; 206/499, 509, 514, 379

[56] References Cited

U.S. PATENT DOCUMENTS

| | | | |
|---|---|---|---|
| D. 216,757 | 3/1970 | Di Pierro et al. | D87/1 |
| D. 262,839 | 2/1982 | Daenen et al. | D3/74 |
| D. 264,896 | 6/1982 | Perkins | D3/74 |
| D. 309,519 | 7/1990 | Remier | D34/46 |
| D. 318,568 | 7/1991 | Håkansson | D3/74 |
| D. 319,074 | 8/1991 | Robinson | D19/75 |
| 2,941,637 | 6/1960 | Silverman | 190/55 |
| 2,983,402 | 5/1961 | Gottsegen | 220/55.7 |
| 3,155,270 | 11/1964 | Taft | 220/55.7 |
| 3,248,167 | 4/1966 | Friedman | 206/370 X |
| 3,392,874 | 7/1968 | Peebles | 220/97 |
| 3,463,353 | 8/1969 | Peebles | 220/97 |
| 3,586,205 | 6/1971 | Van Daalen | 220/97 |
| 3,606,511 | 9/1971 | Henning et al. | 312/266 |
| 3,628,843 | 12/1971 | Wynne et al. | 312/294 |
| 4,029,209 | 6/1977 | Frahm et al. | 206/510 |
| 4,353,182 | 10/1982 | Junkas et al. | 43/54.5 |
| 4,366,998 | 1/1983 | Kaiser | 312/235 |
| 4,416,372 | 11/1983 | Polk | 206/372 |
| 4,460,085 | 7/1984 | Jantzen | 206/349 |
| 4,550,828 | 11/1985 | Baldwin et al. | 206/349 |
| 4,619,363 | 10/1986 | Wolfseder | 206/373 |
| 4,662,515 | 5/1987 | Newby, Sr. | 206/349 |
| 4,674,665 | 6/1987 | Van Kirk | 224/273 |
| 4,714,158 | 12/1987 | Oltman et al. | 206/349 |
| 4,895,256 | 1/1990 | Johnston | 206/501 |
| 5,011,013 | 4/1991 | Meisner et al. | 206/373 |
| 5,040,681 | 8/1991 | Grusin | 206/503 |
| 5,098,235 | 3/1992 | Svetlik et al. | 206/379 X |

*Primary Examiner*—Steven M. Pollard
*Attorney, Agent, or Firm*—Banner & Allegretti, Ltd.

[57] ABSTRACT

A portable storage assembly includes a bottom tub container, a series of at least two trays which nest one within the other and which collectively nest in the tub container and a cover. The assembly is retained in assembled condition by latches along the sides of the container that cooperate with the cover and the trays. The latches are pivotally supported on the tub container. The top of the cover includes a handle which bridges a recess in the top surface. A workpiece retaining groove is defined in the cover and the handle. The cover further includes storage retaining elements molded on the underside of the cover. The nesting trays include a handle in the lower tray which projects through an opening in the upper tray and nests in an aligned handle associated with the upper tray. The handles of the separate trays nest one within the other so that the trays may be simultaneously transported.

12 Claims, 8 Drawing Sheets

PORTABLE STORAGE ASSEMBLY

BACKGROUND OF THE INVENTION

This invention relates to a portable storage assembly comprised of a tublike container, storage trays nested within the container, and a cover. The assembly is especially useful for the storage of tools. The cover of the assembly may be used as a seat or work surface.

In U.S. Pat. No. 5,011,013 there is disclosed a Portable Storage Container which is comprised of a lower tub shaped container, trays inserted in the container and a cover. The disclosed container is useful for the storage of tools, for the transport of tools, as a seat or as a work surface. The disclosure of that patent is incorporated herewith by reference.

While the container disclosed in U.S. Pat No. 5,011,013 is exceedingly useful, improved storage capability, mobility and usefulness as a work surface are desired. The present invention provides a number of such improvements.

SUMMARY OF THE INVENTION

In a principal aspect, the present invention comprises a portable storage assembly which includes a bottom tub container with a top opening, a number of nesting trays inserted in the container and adapted to cooperate with the container, a cover and side locking handles or latches. One feature of the invention is an integrally molded handle in the cover which comprises a handle member that bridges over a recess in the cover and connects co-planar surface panels. A longitudinal groove in the cover surface panels extends along the connecting handle to define a slot or means in the cover to retain a workpiece. The assembly also includes, on the underside of the cover, various integrally molded storage means, such as means for retaining drill bits and the like. The nesting trays retained within the container each include handles which also nest within each other to define a unitary handle so that two or more trays may be simultaneously lifted and carried separate and apart from the container and cover. The latching mechanism for retaining the trays and cover on the container includes latching tabs associated with at least one of the trays that cooperate with a latching arm attached to the tub container.

Thus it is an object of the invention to provide an improved portable storage assembly.

Yet a further object of the invention is to provide an improved portable storage assembly which includes a cover having an integral handle with a unique construction which facilitates support of a workpiece.

Yet a further object of the invention is to provide an assembly for the portable storage of tools and the like which is easily transported and which may be fabricated from lightweight materials which are sufficiently rigid and rugged so that the assembly may be used as a work surface or a seat.

Another object of the invention is to provide an improved portable storage apparatus which may be easily manufactured, which is rugged, lightweight and which includes storage features that are integral with the assembly.

Yet another object of the invention is to provide an improved portable storage assembly which is economical to manufacture and which includes a mechanism whereby multiple nesting tool storage trays may be easily and simultaneously carried by tray handles.

These and other objects, advantages and features of the invention will be set forth in the detail description which follows.

DESCRIPTION OF THE DRAWINGS

In the detailed description which follows reference will be made to the drawing comprised of the following figures.

DESCRIPTION OF THE PREFERRED EMBODIMENT

Overview

Figure 2:
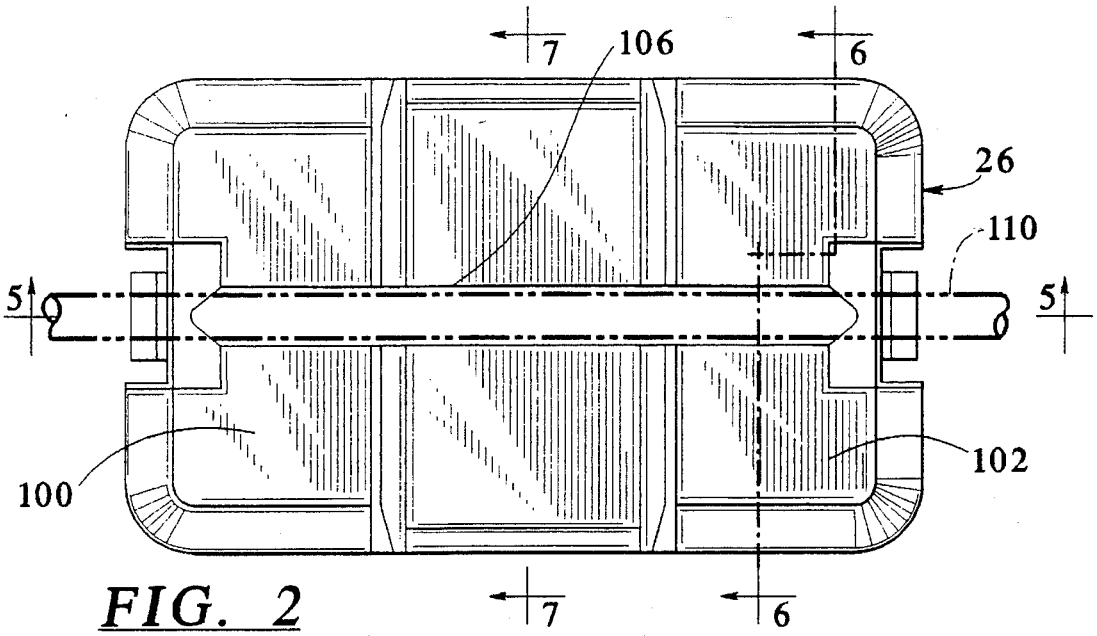
FIG. 2 is a top plan view of the cover of the assembly of FIG. 1.
Figure 1:
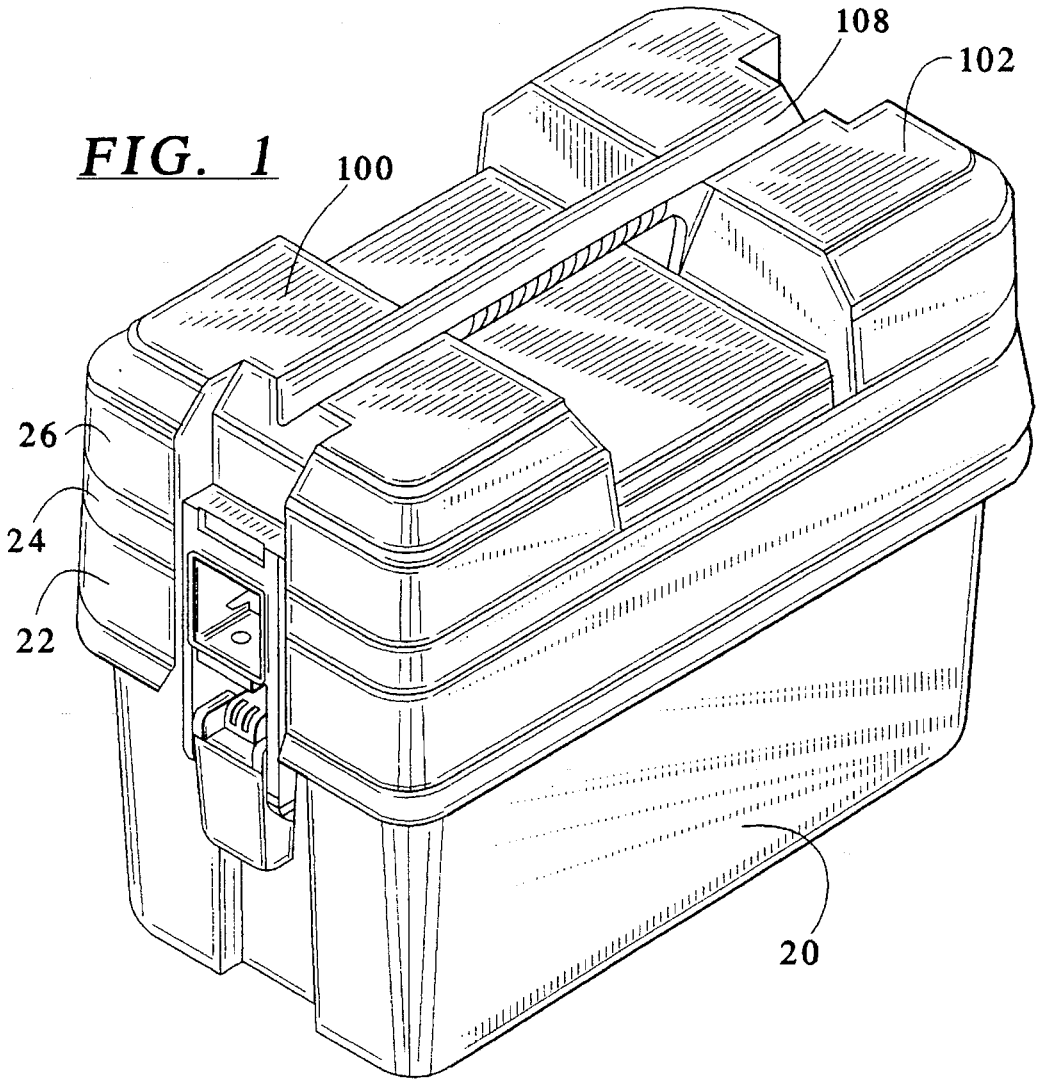
FIG. 1 is an isometric view of the portable storage assembly.
Figure 3:
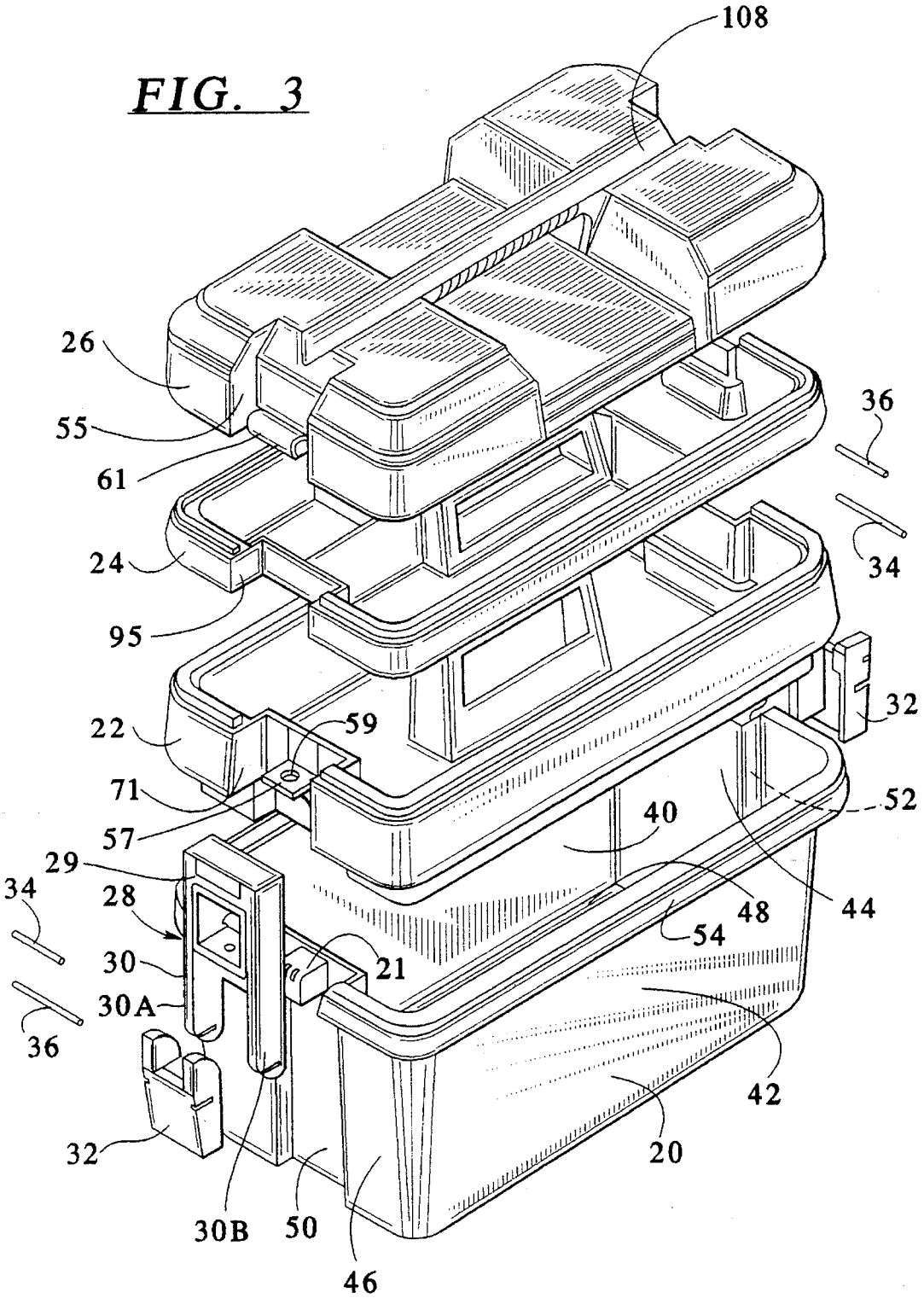
FIG. 3 is an exploded isometric view of the assembly of FIG. 1.
Figure 12:
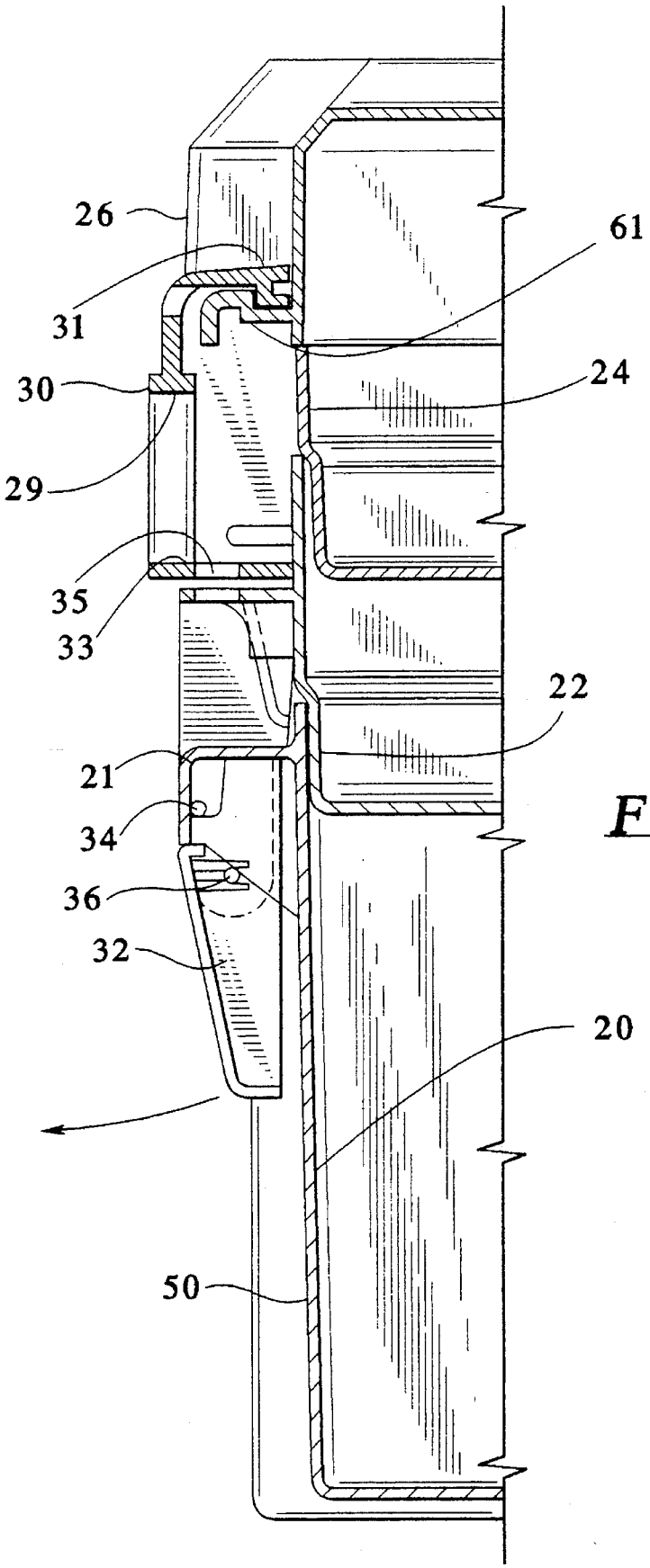
FIG. 12 is a partial side, cross sectional view of the handle construction associated with the assembly of the invention.
Figure 13:
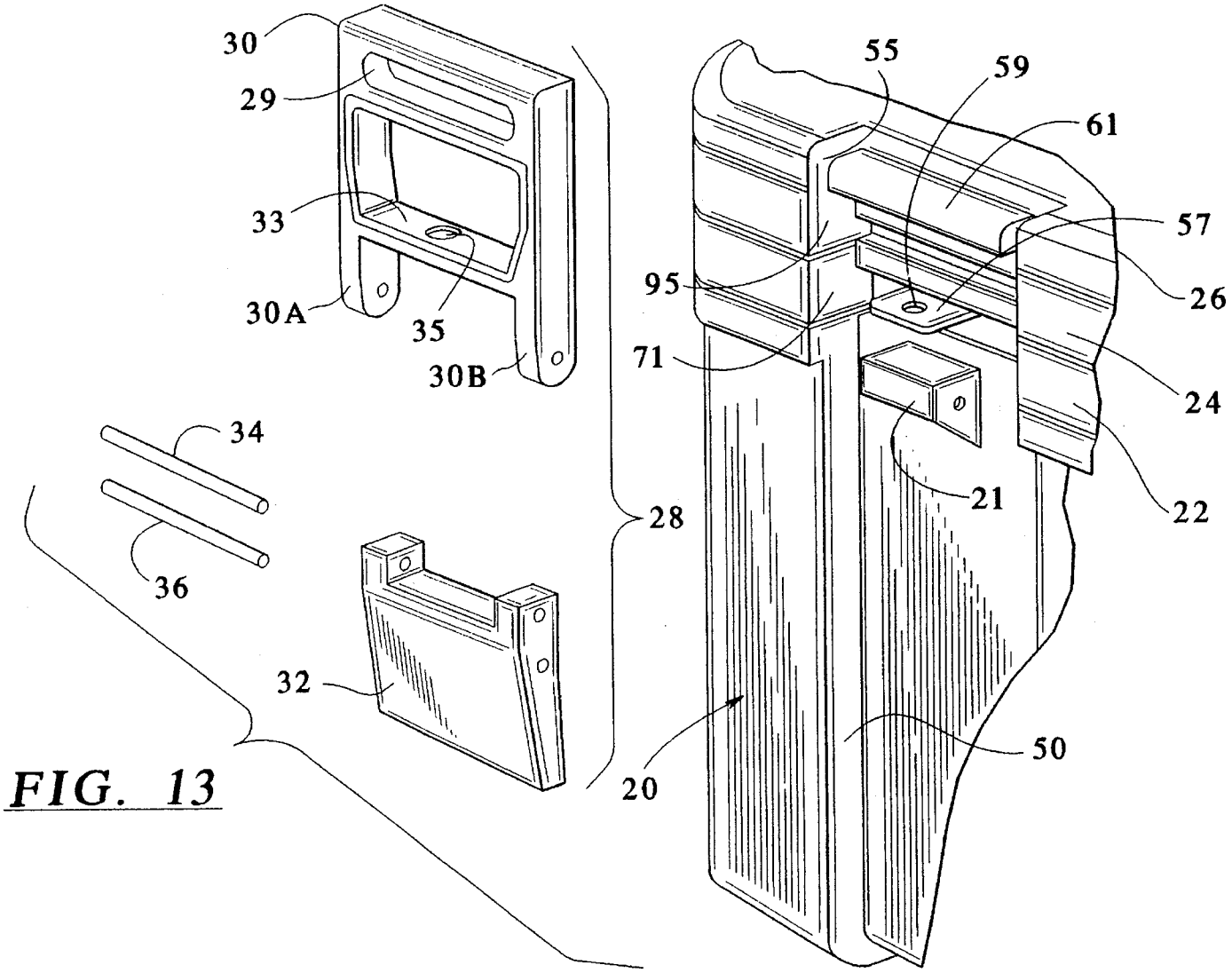
FIG. 13 is an exploded isometric view of the handle or latch construction.

Referring first to FIGS. 1 and 3, the portable storage assembly of the invention includes a bottom container or tublike container 20, a first nesting tray 22, a second or upper nesting tray 24, a cover 26 and side handles or latches 28. The handles 28 are comprised of a latching arm 30, a manual lever 32, and pivot pins 34 and 36. A handle 28 is provided on each side of the tub or container 20. FIG. 1 illustrates the assembly when all the parts are fitted together and latched together by means of the handles 28. FIG. 3 illustrates the assembly in an exploded, isometric view thereby illustrating the manner in which the component parts of the assembly fit together. The cover 26 is illustrated in greater detail in FIGS. 2, 4, 5, 6 and 7. FIGS. 8, 9, 10 and 11 illustrate the construction of the nesting trays in greater detail. FIGS. 12 and 13 illustrate the construction of the handle 28 in greater detail.

The Tub or Container

The tub or container 20 includes opposite, generally parallel sides 40 and 42, generally parallel opposite ends 44 and 46, as well as a bottom 48. The container 20 is typically fabricated from molded plastic material. Each end, 44 and 46, of the container 20 includes an outer, longitudinal, vertical slot or recess 50 which is aligned and positioned at the general midpoint of the ends 44 and 46. Thus, container 20 has a generally rectangular, parallelpiped shape and is sufficiently deep to serve as a storage container. Container 20 includes a molded circumferential, upper peripheral flange 54 which provides the container 20 with sufficient rigidity so as to retain its appropriate configuration for receipt of the nesting tray 22. The flange 54 is also configured to receive, align and support the nesting tray 22.

Nesting Trays

Figure 8:
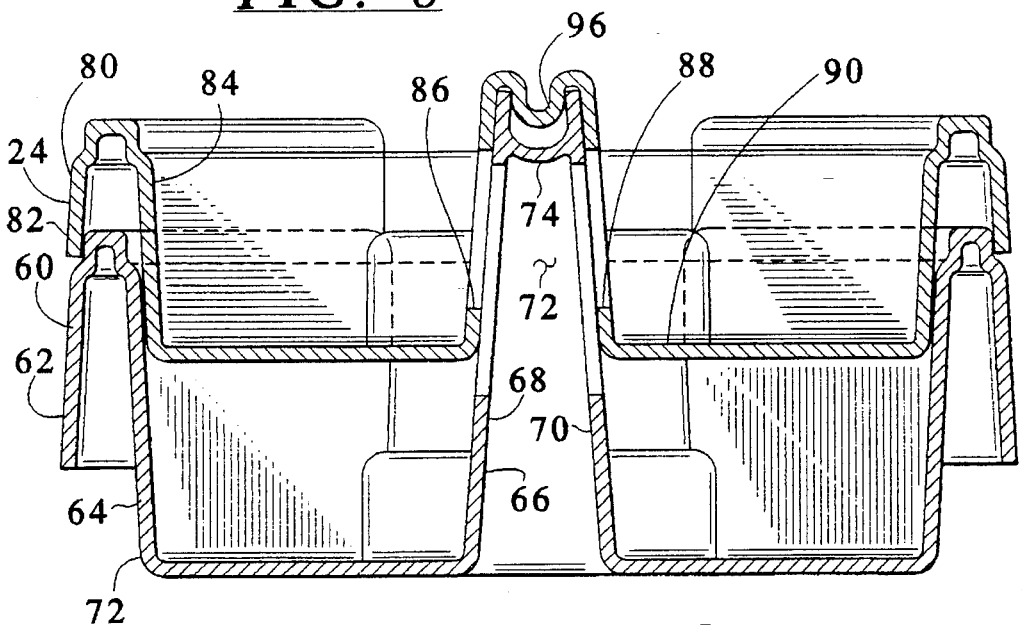
FIG. 8 is a side cross sectional view of two nesting, insertable trays as depicted in FIG. 3.
Figure 9:
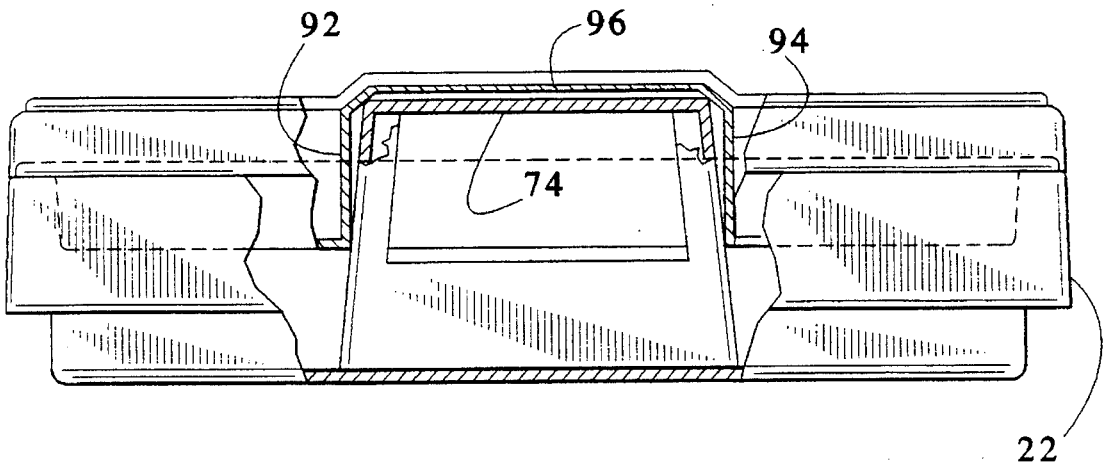
FIG. 9 is a cut away, sectional side elevation of the trays of FIG. 8 and illustrated in the manner in which the trays nest together.
Figure 10:
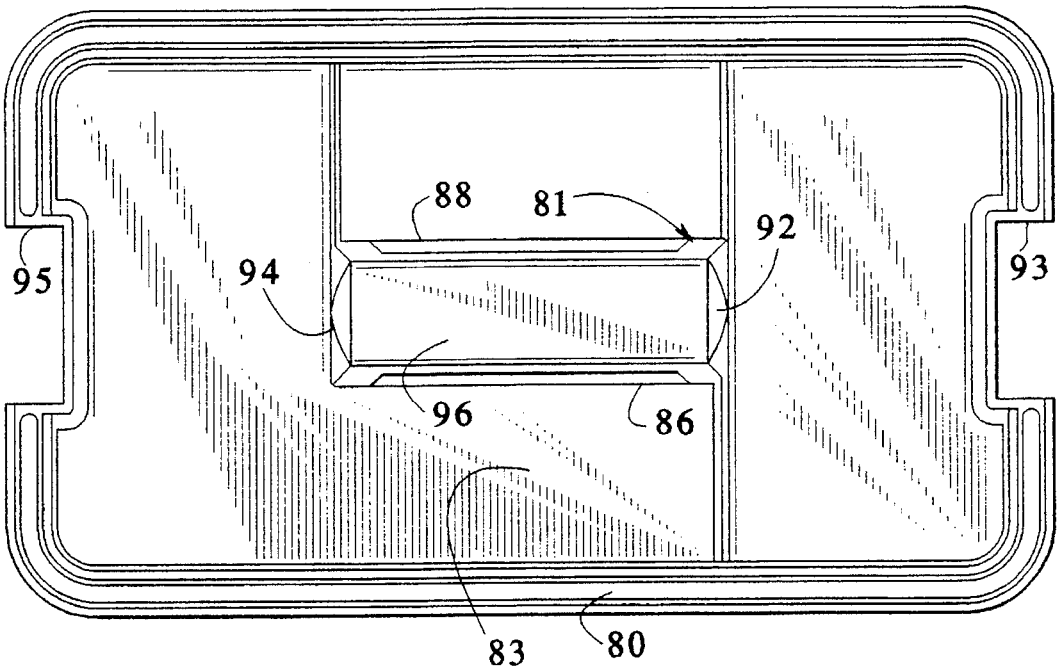
FIG. 10 is a top plan view of the upper nesting tray depicted in FIG. 8.
Figure 11:
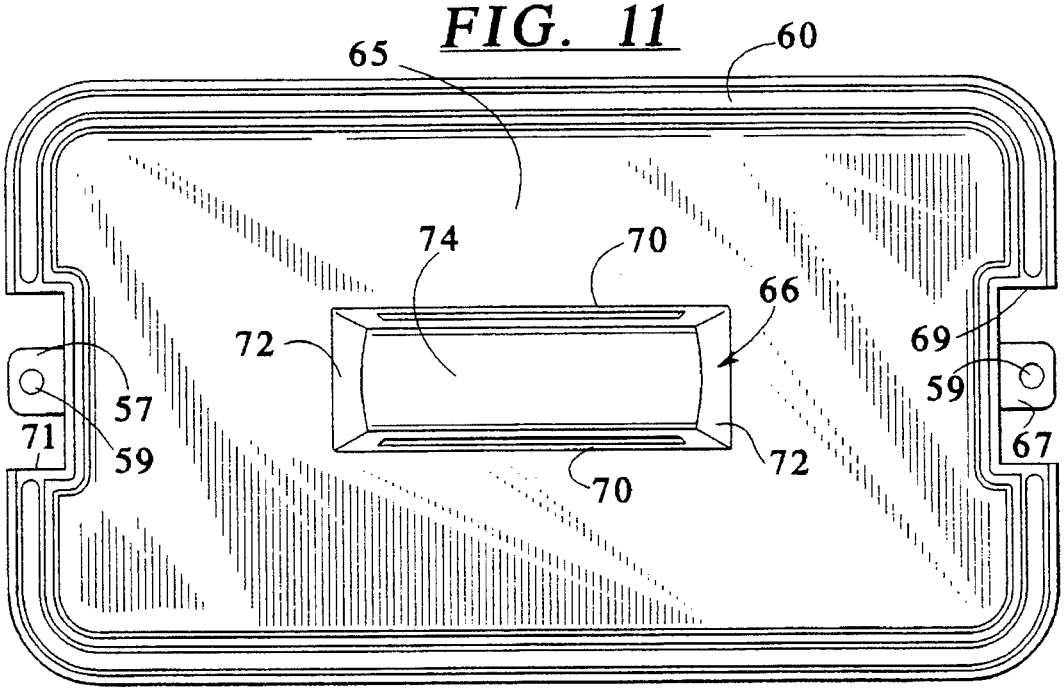
FIG. 11 is a top plan view of the lower nesting tray depicted in FIG. 8.

The lower nesting tray 22, depicted in FIGS. 8, 9 and 11, as well as FIGS. 1 and 3, is a unitary molded tray and includes a peripheral rib 60 which is molded into the tray 22. Again the tray 22 is molded from a plastic material. The molded rib 60 extends about the circumference of the generally rectangular shaped tray 22. The rib 60 includes an outer wall 62 spaced from an inner wall 64 of the tray. The spacing of walls 62, 64 is such that the circumferential rib 60 defines a planar support track which compatibly and cooperatively engages with the flange 54 defined around the periphery of the container 20. In this manner the tray 22 is rigidly and appropriately supported in nesting relation within the container 20. Note that the outer wall 62 of tray 22 is generally a planar extension of outer surface of circumferential flange 54 of container 20. Thus, there are no sharp edges when the container 20 and tray 22 are assembled as depicted in FIG. 1. Note also that the vertical height of outer wall 62 determines the depth of nesting of tray 22 in container 20. Also, outer wall 62 in combination with the inner wall 64 serves to securely position the tray 22 in container 20 since inner wall 64 is nested within and thus is opposed to the inside wall of container 20.

The unitary molded tray 22 includes a molded center handle 66 which is integral with the remainder of the tray 22 and projects upwardly from the center of a base surface 65 of tray 22. The handle 66 includes upwardly extending side walls 68 and 70. The side walls 68 and 70 join with end walls 72. The end walls 72 project above the side walls 68 and 70 and are connected by a cross handle member 74 which has a concave outer surface and is curved downwardly toward the bottom surface 65 of the tray 22. This provides for a comfortable manual gripping surface for gripping the handle member 74. Lower tray 22 includes end slots 69, 71 for receipt of the handle 28. Also, a projecting locking tab 57 with opening 59 is provided in each slot 69, 71.

The upper nesting tray 24 has a construction somewhat similar to that of the lower nesting tray 22. Specifically the upper nesting tray 24 is unitary and formed from a molded plastic material with a bottom wall or base 83. The upper nesting tray 24 also includes a peripheral, circumferential rib 80 which is defined by an outer wall 82 spaced from inner circumferential wall 84. The spacing is such that the outer wall 82 and inner wall 84 cooperatively engage and are supported by the peripheral rib 60 of the lower nesting tray 22 in a manner depicted in FIG. 8, whereby the upper tray 24 fits into or nests in the inner tray 22 with the bottom 83 of the upper tray 24 positioned within the side inner wall 64. Thus, the wall 84 which has a draft angle fits or nests in wall 64, is opposed thereto and thereby is held securely in place. The depth of the nesting is dependent upon the height of outer wall 82. Note, the depth of nesting is thereby variable depending upon outer wall height, but in all events the wall provides for nesting.

Similarly, the upper nesting tray 24 includes a center handle 81 projecting from base 83 which comprises a longitudinal wall 86 and a parallel wall 88 which extend in the longitudinal direction of the tray 24, but extend only partially up from the bottom surface 83 of the tray 24. The handle 81 further includes upwardly extending end walls 92 and 94. Also provided is a cross handle member 96 which has a concave shape so that it will nest appropriately within the concave cross member 74 of the tray 22. The nesting cross members 74, 96 may help limit the degree of nesting by trays 22, 24. That is, the nesting trays 22, 24 which slide together, may be dimensioned to control the degree of nesting in any one of a number of ways. The height of outer walls 82 may control. The heights of handle cross members 74, 96 may control. The draft angles of side walls and dimensions of side walls 64, 84 may control. Combinations thereof may control the degree of nesting or may be coordinated dimensionally to control the degree of nesting. In any event, the interaction of bottom surface 83 of upper tray 24 with the lower tray 22 does not control nesting and the trays 22, 24 are therefore not vertically stacked. Rather, they are nested.

End slots 93, 95 are defined in the ends of tray 24 for receipt of the latches 28. The nesting trays 22 and 24 are generally congruent with respect to their shape and with respect to the dimensioning of the handles 74, 96 as well as the side ribs 60 and 80. The nesting trays 22, 24 thus fit together in the manner depicted in FIGS. 1 and 3.

Cover

FIGS. 2, 4, 5, 6 and 7 illustrate the cover 26 construction in greater detail. Referring to those figures, the cover 26 includes a first generally planar support surface 100 and a second generally planar support surface 102. The surfaces 100 and 102 generally lie in the same plane and are spaced from one another by a detent or recess 104 molded into the cover 26. An integrally molded handle 106 connects the planar surfaces 100 and 102 over the recess 104. A longitudinal groove 108 is defined in the planar surfaces 100 and 102 and extends in the longitudinal direction of the handle 106 to define a means for retaining a workpiece, such as workpiece 110 illustrated in FIGS. 6 and 7. It is preferable that the handle 106 associated with the cover 26, as well as the handles 74, 96 associated with the various trays, be all aligned in the same direction and be positioned along a horizontal centerline. Also, handle 106 is curved on its bottom surface over recess 104, for ease of manual gripping. Note that the surfaces 100 and 102 can serve as a workbench or as a seat support.

Figure 4:
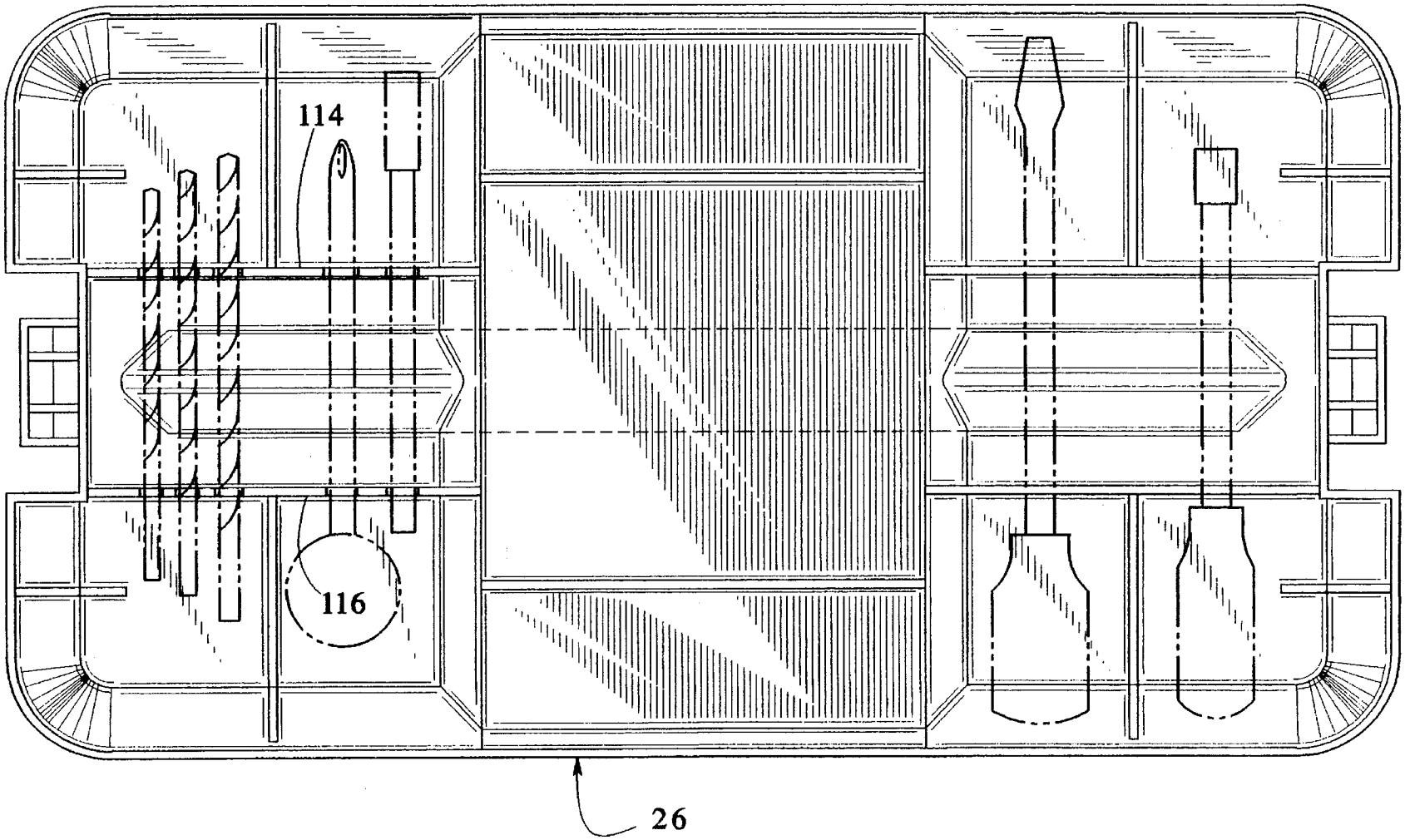
FIG. 4 is a bottom plan view of the cover of the assembly of FIG. 1.
Figure 5:
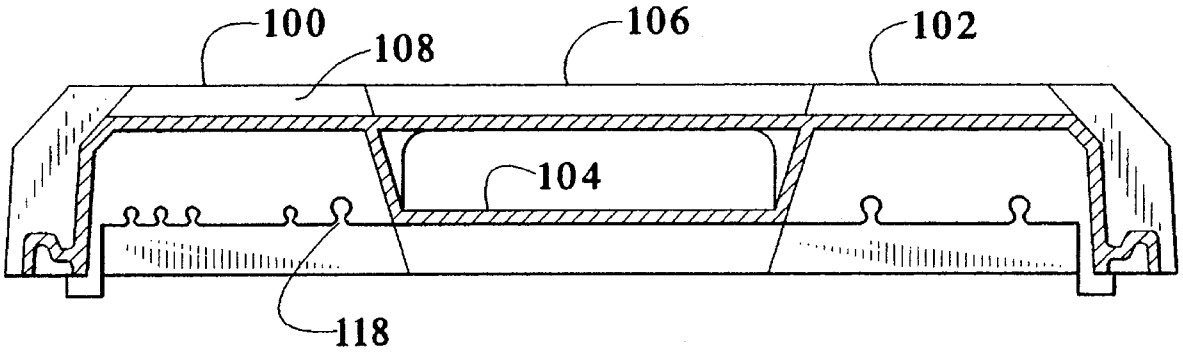
FIG. 5 is a cross sectional view of the cover of FIG. 2 taken substantially along the line 5—5.
Figure 7:
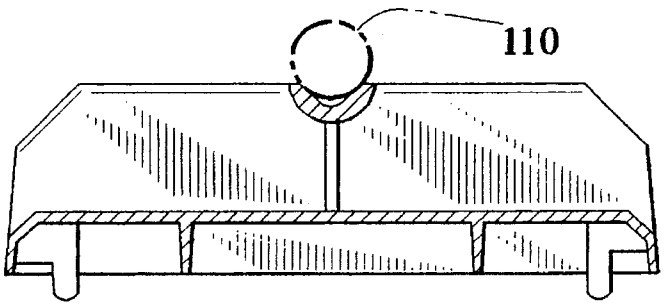
FIG. 7 is a cross sectional view of the cover of FIG. 2 taken substantially along the line 7—7.
Figure 6:
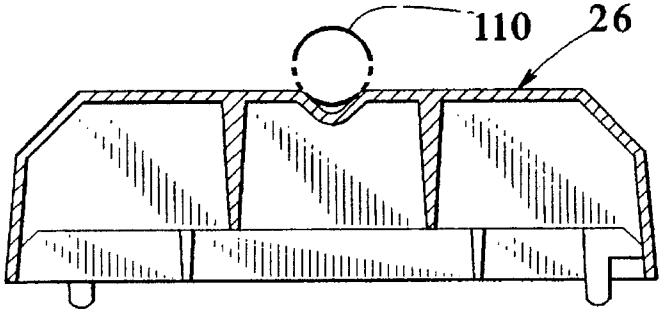
FIG. 6 is a cross sectional view of the cover of FIG. 2 taken substantially along the line 6—6.

FIG. 4 illustrates in greater detail the construction of the undersurface of the cover 26. The undersurface includes various ribs such as ribs 114 and 116. The ribs 114, 116 include various slots, such as slots 118, for receipt of tools which are depicted in phantom in FIG. 4. The arrangement of the ribs 114, 116 is such that the ribs 114, 116 are provided on either side of the recess 104 and serve to strengthen the cover 26 while at the same time providing extra storage on the underside of the cover 26. Note that it is preferable that the ribs 114, 116 are designed to run in the longitudinal direction of the groove 108 and not interfere with that groove 108 although various other rib patterns may be used to provide for rigidity of the cover 26.

Handle Construction

FIGS. 12 and 13 illustrate in greater detail the handle 28 construction and the manner in which the handle 28 is cooperative with the cover 26 as well as the two nesting trays 24 and 22 in combination with the container 20. Specifically, handle 28 is retained within aligned recesses 50, 71, 95, and 55 defined longitudinally in the side of each of the component elements including the container 20, nesting tray 22, nesting tray 24 and cover 26. As shown in the figures, the recess 50 thus is aligned with and compatible with a recess 71 in tray 22, a recess 95 in tray 24, and a recess 55 in cover 26. The nesting tray 71 also includes the tab 57 which projects into the recess 71 and includes an opening 59 therethrough. The recess 55 of cover 26 includes a lateral projection 61 projecting therein for cooperation with the locking member 30 of the handle 28.

Referring again to FIGS. 12 and 13, the handle member 30 includes an overlapping flange 31 which cooperates with the locking flange or projection 61 of the cover 26 to thereby lock or engage the cover 26 in position. The handle 30 also includes a lateral cross member 33 with an opening 35 therethrough that aligns with the opening 59 associated with nesting tray 22 so that a padlock, for example, can be inserted therethrough to lock the total assembly in a closed condition.

Cooperating, pivotal manual lever 32 is fastened by means of pin 34 to a projecting hinge member 21 molded in the container 20 and projecting into the recess 50. Lever 32 is connected by means of pin 36 to the lower extension arms 30A and 30B of the pivotal handle member 30. Thus, when the manual lever 32 is pivoted in the direction depicted by the arrow in FIG. 12, it will cause the arms 30A and 30B to move outwardly and ultimately upwardly thereby releasing the latch 31 from the projection 61. The reverse operation may be effected to attach the latch 31 to the projection 61.

The pins 36 and 34 are spaced from one another and dimensionally positioned so that the manual lever 32 has an overcenter acting effect. That is, when latch 31 is engaged with projection 61 and the pins 34 and 36 are aligned directly vertically as depicted in FIG. 12, the handle assembly is under some tension. That tension is released by movement by the manual lever 32 in a counterclockwise direction as depicted in FIG. 13 so that the latch handle 28 is in a retained or stored position. The overcenter acting force can be overcome due to the resilience of the component parts of the handle 28 so that when the handle 28 is pivoted about the pin 34 it will initially have any increased resistance, but then a lowered resistance as the handle 28 is fully opened. Both of the handles 28 operate in substantially the same manner and are similar in construction in the handles depicted in prior art U.S. Pat. No. 5,011,013 with one exception being that handles 28 interlock with projection 57 of tray 22. Also, each handle member 30 includes a molded hand holding opening 29.

Among the key features of the invention is the arrangement whereby the nesting trays 22 and 24 are all generally congruent with the container 20 and the outer peripheral ribs or ridges of each of the trays and the container 20 provide a smooth outside surface of the storage assembly and also provide a means for aligning the various component parts. Further, the nesting arrangement of the handles 66, 81 associated with the trays 22 and 24 is designed so that both trays may be simultaneously moved. The use of a locking tab 57 in conjunction with the handle 28, the construction of the cover 26 wherein a longitudinal groove 108 is provided in the handle 106 connecting separated support surfaces, and the use of the reinforcing ribs 114, 116 on the lower side of the cover 26 to enhance the storage capability of the assembly in the combination depicted and shown are all believed to be important and distinct features of the invention. Nonetheless, it is possible to vary the invention by additional, substitute or equivalent features such as the utilization of alternative handle designs and alternative cover designs. Thus, the invention is to be limited only by the following claims and their equivalents.

What is claimed:

1. A portable storage assembly comprising, in combination:

a bottom tub container having a top opening, a cover for the tub container top opening, said cover including a generally planar top surface with a recess portion, a handle for the cover over the recess portion connecting sections defining a generally planar top surface, said handle being generally coplanar with the top surface;

a longitudinal groove in the top surface, said groove also extending along the handle, said groove defining means for retaining a workpiece; and means for removably latching the cover to the bottom tub container.

2. A portable storage assembly comprising, in combination:

a bottom tub container having a top opening;

a first tray removably insertable against the top opening of the bottom tub container, supported by the tub container, and nesting within the tub container, said first tray including a top side and at least one handle projecting upwardly when the first tray is positioned on the tub container;

a second tray removably nesting within the first tray, said second tray including at least one handle projecting upwardly when the second tray is nested in the first tray, said second tray including an opening therethrough for receipt of the first tray handle, said opening and said second tray handle aligned with the first tray handle, said handles being nested together when the trays are nested together and consolidated in a unitary configuration to permit simultaneous carrying of the trays by the nested handles; and a cover removably insertable against the second tray, said cover including a generally planar outer top surface with a recess portion, a handle for the cover over the recess portion, said handle connects sections defining the planar top surface, said handle being generally coplanar with the top surface, said top surface and handle including a straight line, longitudinal groove defining means for retaining a workpiece.

3. The portable storage assembly of claim 2 further including means for removable latching the cover to the tub container and for simultaneously retaining the trays in position between the cover and tub container.

4. The portable storage assembly of claim 3 wherein the means for latching includes a latching arm attached to a side of the tub container, said arm including a free end releasably cooperative with an edge of the cover to engage and retain or to disengage and release the cover, said cover, tub container and trays all including an aligned side recess in the assembled condition for receipt of the latch ring arm for protection of the arm and for alignment of the parts of the assembly.

5. The portable storage assembly of claim 3 wherein the means for latching includes a latching arm pivotally attached to a side of the tub container, said arm including a free end releasably cooperative with an edge of the cover to retain said cover and said trays, one of said trays including a projecting locking tab projecting from a side of said tray in alignment with the latching arm and projecting through the latching arm when the arm is engaged with the cover, said locking tab including a lock receiving portion for cooperative engagement with a removable locking means; said locking means precluding release of the latching arm from the cover when engaged with the locking tab.

6. The portable storage assembly of claim 3 wherein the means for latching includes a latching arm attached to a side of the tub container, said arm including a free end releasably cooperative with an edge of the cover to engage and retain the cover and trays, said latching arm further including a hand opening for manual gripping and support of the assembly.

7. The portable storage assembly of claim 2, wherein the tub container, cover and trays have a congruent peripheral shape.

8. The portable storage assembly of claim 2 wherein the tub container, trays and cover have intersecting vertical planes of symmetry with respect to the peripheral shape thereof to permit removable and reversible insertion of the trays and cover.

9. The portable storage assembly of claim 2 wherein the top surface of the cover is textured in a pattern to enhance adherence of an object thereon.

10. The portable storage assembly of claim 2 wherein the cover includes an underside storage means.

11. The portable storage assembly of claim 10, wherein the underside storage means comprise a plurality of tool holders molded in the underside of the cover.

12. The portable storage assembly of claim 10, wherein the cover comprises a molded plastic material integrally molded with underside storage means.

* * * * *